US006955269B2

(12) United States Patent
Menz

(10) Patent No.: US 6,955,269 B2
(45) Date of Patent: Oct. 18, 2005

(54) WEIGHTED PUSHER

(75) Inventor: Albert Menz, New York, NY (US)

(73) Assignee: Display Technologies, LLC, College Point, NY (US)

( * ) Notice: Subject to any disclaimer, the term of this patent is extended or adjusted under 35 U.S.C. 154(b) by 39 days.

(21) Appl. No.: 10/685,024

(22) Filed: Oct. 13, 2003

(65) Prior Publication Data

US 2005/0077259 A1 Apr. 14, 2005

(51) Int. Cl.[7] ..... A47F 1/00
(52) U.S. Cl. ..... 211/59.3; 211/51; 312/71
(58) Field of Search ..... 211/59.3, 184, 211/183, 59.2, 175; 312/42, 71, 61, 35; 248/910

(56) References Cited

U.S. PATENT DOCUMENTS

| | | | | |
|---|---|---|---|---|
| 2,886,182 A | | 5/1959 | Dauman | |
| 2,945,613 A | | 7/1960 | Gerding et al. | |
| 3,348,732 A | | 10/1967 | Schwarz | |
| 4,457,512 A | * | 7/1984 | Stevenson | 273/148 A |
| 4,762,235 A | | 8/1988 | Howard et al. | |
| 4,836,390 A | * | 6/1989 | Polvere | 211/59.3 |
| 4,854,570 A | | 8/1989 | Martin et al. | |
| 5,088,607 A | | 2/1992 | Risafi et al. | |
| 5,562,217 A | | 10/1996 | Salveson et al. | |
| 5,605,237 A | * | 2/1997 | Richardson et al. | 211/59.3 |
| 5,634,564 A | | 6/1997 | Spamer et al. | |
| 5,638,963 A | | 6/1997 | Finnelly et al. | |
| 5,673,801 A | * | 10/1997 | Markson | 211/59.3 |
| 5,685,664 A | | 11/1997 | Parham et al. | |
| 6,142,317 A | | 11/2000 | Merl | |
| 6,234,328 B1 | * | 5/2001 | Mason | 211/90.02 |
| 6,378,727 B1 | * | 4/2002 | Dupuis et al. | 221/92 |
| 6,691,891 B2 | * | 2/2004 | Maldonado | 221/279 |
| 6,769,552 B1 | * | 8/2004 | Thalenfeld | 211/59.3 |
| 2002/0148794 A1 | * | 10/2002 | Marihugh | 211/59.3 |

* cited by examiner

*Primary Examiner*—Jennifer E. Novosad
(74) *Attorney, Agent, or Firm*—Amster, Rothstein & Ebenstein

(57) ABSTRACT

A weight-driven pusher for product on a gravity-fed display shelf includes a weighted frame. A front plate is mounted on the frame and manually adjustable in upper reach relative to the frame to accommodate product of varying height and preclude product from tipping rearwardly over the pusher. A leg assembly is retractably mounted on the frame adjacent the bottom thereof and biased to project rearwardly from the frame to preclude product from tipping the pusher over backwards.

4 Claims, 4 Drawing Sheets

WEIGHTED PUSHER

BACKGROUND OF THE INVENTION

The present invention relates to a weighted pusher for use on a gravity-fed display shelf, and more particularly to such a weighted pusher having a front plate and a rear leg assembly.

Typically various shelves in a supermarket, grocery store or the like are disposed in a downward and forward orientation so that an entire column of product (i.e., the product train) will slide forwardly and downwardly under the influence of gravity to the front of the shelf (where it is usually blocked by an upstanding ledge or stop). Where the friction of the product train on the shelf floor is too high for such movement of the product train under the influence of gravity alone, a spring-loaded pusher is frequently used to drive the rear of the product train forwardly and downwardly, the spring force enabling the product train to overcome the friction. Such spring-loaded pusher structures are often complex, problematic and not favored in a freezer compartment where the cold temperature may have an adverse effect on the relatively powerful spring which must be used to drive the pusher. Thus, a weight-driven pusher (containing a heavy weight therein to overcome friction) is often used on a tilted gravity-fed tray. However, the conventional weight-driven pusher is not entirely satisfactory in practice.

Unless the front of the main body of the pusher is sufficiently high in upper reach, during loading of product from the shelf front, the rearmost product may tip rearwardly over the top of the pusher when the center of gravity of the rearmost product is higher than the top of the pusher. (Typically the main body of the pusher is relatively low since a high pusher limits the number of shelves that can be stacked one on top of the other in the freezer, thereby wasting valuable space which may not be needed for the particular product.) In the past, this has been prevented, e.g., through the use of a sled wherein the weight-driven pusher was mounted on a sled which also carried on the front thereof an upright one of the products (on a protected ledge in front of the pusher) in such a manner that the effective height of the pusher was equal to the effective height of the one upright product placed on the sled. This meant that the effective pushing force of the sled on the rearmost product of the product train in front of the sled was at least as high as such rearmost product so that the latter could not tip rearwardly over the sled. By way of background, see FIGS. 6 and 7 of Mason U.S. Pat. No. 6,234,328. However, in practice the sled-carried product tended to remain unsold, ignored by potential customers, and forgotten about by store personnel, with the result that it eventually became stale and unsaleable, in effect wasted product.

Further, where the center of gravity of the rearmost product of the product train was higher than the center of gravity of the weight-driven pusher, the rearmost product at the back of a heavy or long product train could exert a resistance or inertia on the front plate at a point above the center of gravity of the pusher and therefore tend to tip the pusher over rearwardly so that it landed on its back and could no longer perform its function. In the past, this has been prevented by the provision of a fixedly-mounted leg which extended rearwardly from the rear of the pusher and acted to stabilize the pusher against rearward tipping over. In effect, the leg acted as a rearwardly extending outrigger and extended the effective length of the base of the pusher to eliminate accidental rearward tipping thereof. However, the presence of the leg extending rearwardly out of the pusher increased the footprint of the pusher so that it occupied more valuable shelf space, with the result that there could be fewer products in the product train.

Accordingly, it is the object of the present invention to provide a weight-driven pusher which in a preferred embodiment uses no sled (and thus does not carry any product on a sled).

Another object to provide such a weight-driven pusher which in a preferred embodiment has a small footprint on the display shelf and does not have a rearwardly extending leg occupying valuable shelf space when the shelf is being loaded with a product train (so that the length of the product train may be maximized).

A further object is to provide such a weight-driven pusher which in a preferred embodiment has neither a sled nor a permanent rearwardly extending leg.

It is also an object of the present invention to provide such a weight-driven pusher which in a preferred embodiment is suitable for use in a display shelf in a freezer.

It is another object to provide such a weight-drive pusher which in a preferred embodiment is simple and economical to manufacture, use and maintain.

SUMMARY OF THE INVENTION

It has now been found that the above and related objects of the present invention are obtained in a weight-driven pusher for product on a gravity-fed display shelf associated with a backstop wherein the pusher comprises a frame, a front plate, a leg and biasing means. The frame defines a compartment containing a weight and adapted for sliding movement along a gravity-fed display shelf. A front plate is mounted on the frame in a generally vertical orientation for bearing on the back of product, the front plate being manually adjustable in upper reach relative to the frame to accommodate product of varying height and prevent product from tipping rearwardly over the pusher. The leg assembly is retractably mounted on the frame adjacent the bottom thereof for retraction into the frame as the back of the leg assembly bears on the back stop. Means are providing for biasing the leg assembly to project rearwardly from the frame when the back of the leg assembly is spaced from the back stop of the shelf, thereby to preclude product from tipping the pusher over backwards.

In a preferred embodiment, the leg assembly projects rearwardly in a generally horizontal plane, while the front plate is manually adjustable in a generally vertical plane.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
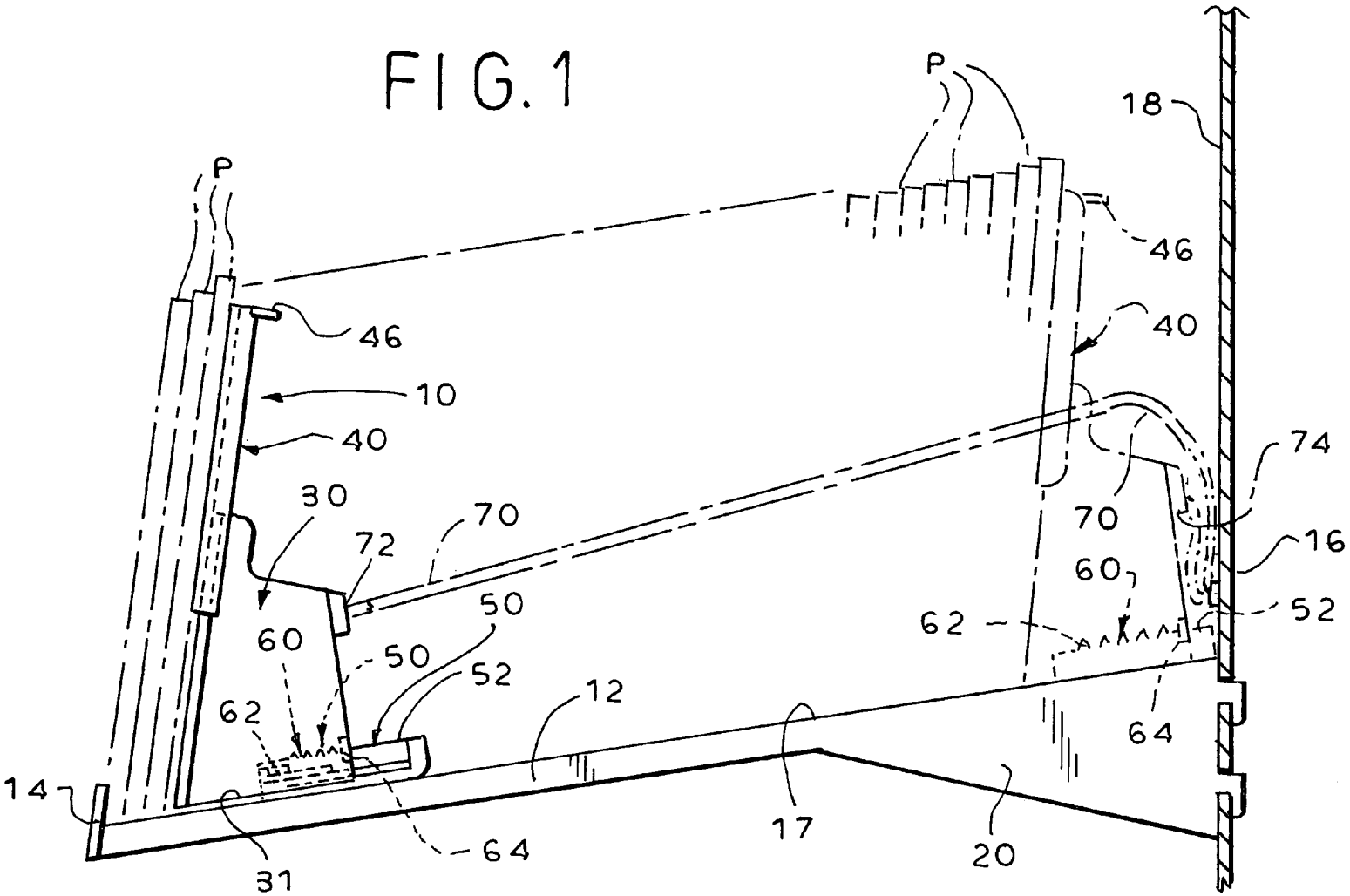
FIG. 1 is a fragmentary side elevational view of a gravity-fed display shelf having a weight-driven pusher according to the present invention thereon illustrated in solid line in a position of use and in phantom line in an extreme product loading position.

Referring now to the drawing, and in particular to FIG. 1 thereof, therein illustrated is a weight-driven pusher according to the present invention, generally designated by the reference numeral 10. The pusher 10 rests on a conventional gravity-fed display shelf, generally designated 12, associated with a front stop 14 and a back stop 16. The pusher 10 drives forwardly a product train formed of several items of product P along the floor 17 of the gravity-fed display shelf 12 until the lead product is stopped by the front stop 14 (which may simply be an upstanding ledge at the front of the shelf 12, as illustrated, or any of the more complex stops well known in the display shelf art). The back stop 16 may simply be an upstanding ledge at the back of the shelf 12, whether the back stop 16 is actually part of the shelf 12 or upright 18, or a separate element such as a wall abutting the back of the shelf 12. As is conventional in the art, the shelf 12 is supported in a forward and downward inclination by uprights 18 and braces 20 connecting the shelf 12 and uprights 18 and maintaining the shelf 12 in the forward and downward inclination relative to the uprights 18.

Figure 2:
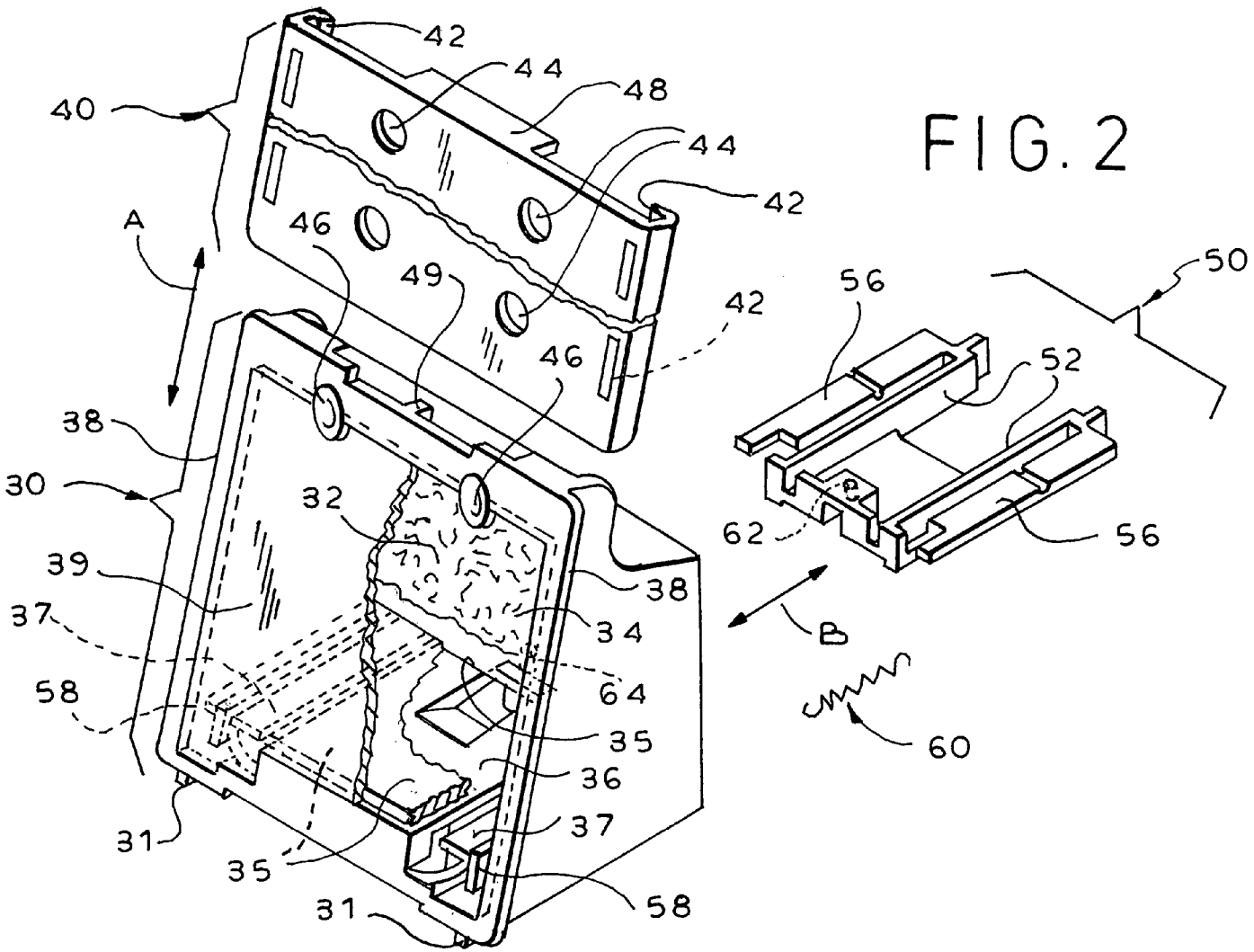
FIG. 2 is a fragmentary exploded isometric view of the weight-driven pusher.
Figure 3:
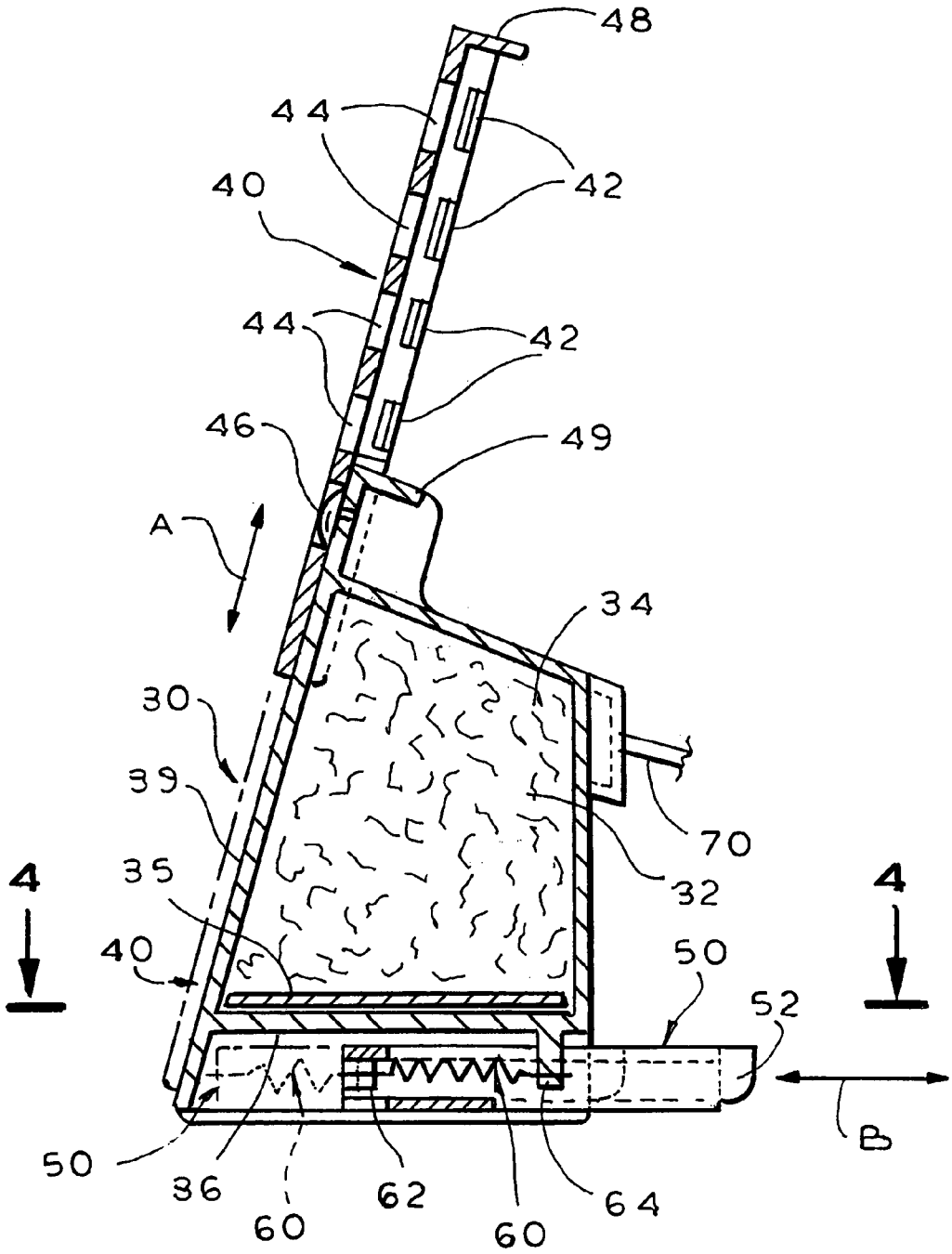
FIG. 3 is a sectional view of the weight-driven pusher, with the front plate being illustrated in a raised position and the leg assembly being illustrated projecting rearwardly in solid line, and the front plate also illustrated in a lowered position and the leg assembly also illustrated in a retracted position in phantom line.
Figure 4:
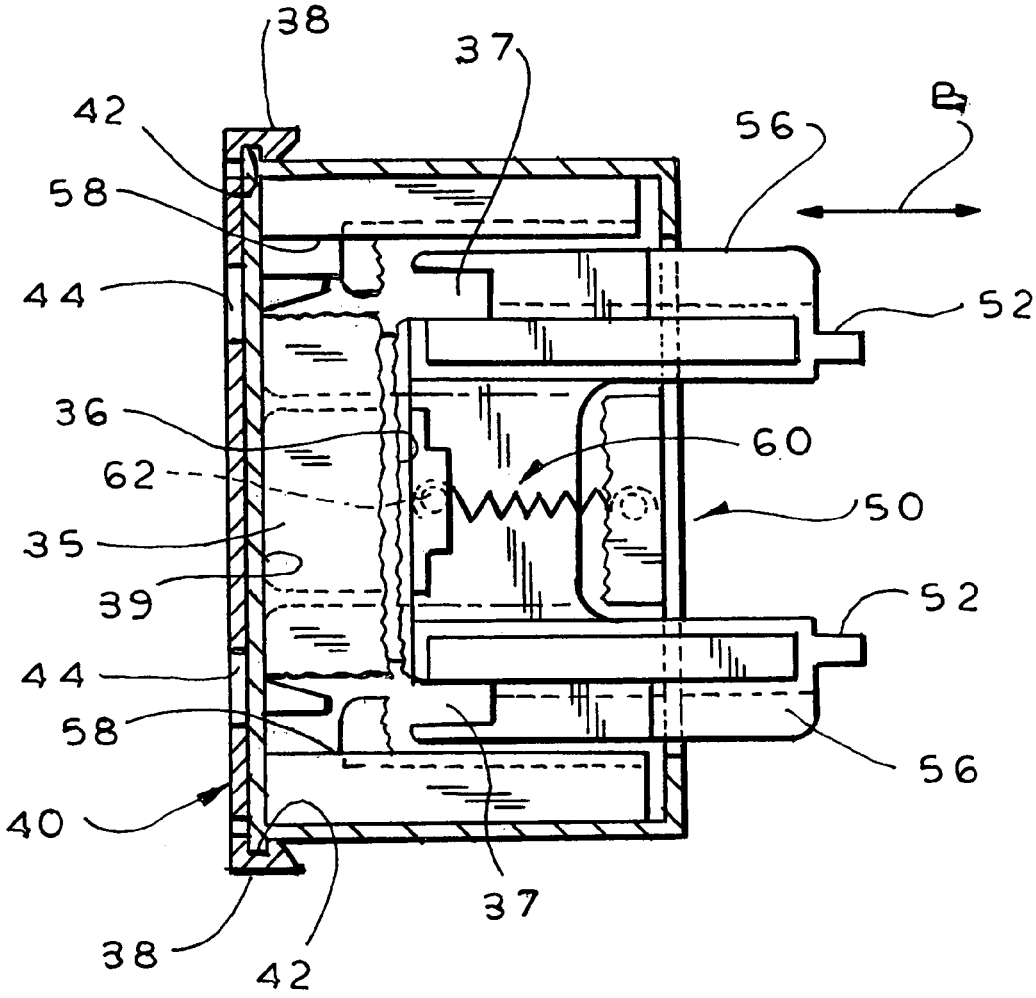
FIG. 4 is a sectional view taken along the line 4—4 of FIG. 3.

Referring now to FIGS. 2–4 and to the exploded view of FIG. 2 in particular, therein illustrated are the various components of the pusher 10. A frame, generally designated 30, is adapted for sliding movement along the inclined floor 17 of the gravity-fed display shelf 12. The floor 31 of the frame 30 rides on the floor 17 of the shelf 12, both floors preferably being formed of a smooth, relatively non-stick plastic, such as polypropylene, to promote the aforementioned sliding movement. The frame 30 defines an upper compartment 32 (see FIG. 3) containing a weight 34 sufficient to effect sliding movement of the pusher 10 and a complete product train along the floor of shelf 12. The weight 34 may be formed of any high density material which is economically available, such as scrap metal pieces, scrap metal shavings, BB's or the like. About 4 pounds is typically sufficient for driving a food product train along a gravity-fed display shelf 12. While the weight-containing upper compartment 32 is illustrated as being sealed, alternatively a user-accessible upper compartment may be provided. The advantage of a user-accessible upper compartment is that the pusher can be inexpensively shipped without the weight, and a convenient weight later added to the upper compartment by store personnel, prior to use of the pusher.

A lower compartment 36 (see FIGS. 3 and 4) is disposed beneath a horizontally extending divider 35 which acts as the floor of upper compartment 32. The lower compartment 36 is open at the rear thereof and defines a pair of horizontal surfaces extending forwardly from the rear of the lower compartment 36, the surfaces acting as courses 37 in a manner which will become apparent hereinafter. Additionally, the front 39 of the frame 30 defines on each lateral side thereof a vertically extending series of outwardly projecting lateral flanges 38 preferably extending the full height of the frame 30.

A front plate, generally designated 40, is slidably mounted on the front of frame 30 in a generally vertical orientation. The front face of front plate 40 is adapted for bearing on the back of product P, and in particular on the back of the trailing product P in the product train. In order for the front plate 40 to assume a generally vertical orientation when the pusher 10 is disposed on the tilted shelf 12, the front plate 40 is preferably tilted rearwardly at about the same angle as the shelf 12 is tilted downwardly. However, since it is generally preferred that the product P in the product train tilt upwardly and rearwardly slightly, the generally vertical orientation of the front plate 40 is preferably also slightly upwardly and rearwardly tilted even on shelf 12.

The front plate 40 is generally planar in design with underturned lateral edges defining channels 42 of U-shaped cross section for receipt therein of the lateral flanges 38 extending outwardly from the front of frame 30. The channels 42 enable a generally vertical sliding movement of the front plate 40, along the lateral flanges 38, by store personnel. Thus, as illustrated by double-headed arrow A, the front plate 40 is manually adjustable in upper reach, relative to the frame 30, to accommodate product P of varying height and thereby prevent the product P from tipping rearwardly over the pusher 10.

To retain the front plate 40 at the upper reach to which it has been manually adjusted by store personnel, the front plate 40 is provided with a matrix of apertures (or recesses) 44 configured and dimensioned to have a horizontal row thereof be releasably engaged by at least one forwardly extending projection 46 on the front face of the frame 30. Alternatively or additionally, the channels 42 may frictionally engage the lateral flanges 38 with sufficient force to maintain the front plate 40 at its manually adjusted height, against accidental displacement, while freely allowing intentional manual adjustment thereof. Those skilled in the mechanical arts will appreciate that a variety of different engaging mechanisms may be used to provide intentional manual adjustability of the front plate 40 in upper reach relative to the frame 12, while precluding accidental adjustment thereof.

It will be appreciated that the front plate 40 does not necessarily extend to the top of the trailing product P on the shelf 12; it is only necessary that the trailing product P of the product train cannot tip rearwardly over the top of the frame/front plate subassembly 30/40. Preferably the front plate 40 is manually adjusted in upper reach so that its upper reach is at or above the upper reach of the trailing product P or, at least, above the center of gravity of the trailing product P. Because the front plate 40 is easily manually adjustable in upper reach by store personnel, it may be manually raised or lowered as necessary for any particular product P so that its upper reach is only enough to prevent the trailing product P from tipping over the pusher 10, without wasting any additional space above the shelf 12 which might gainfully be employed by another shelf.

Downward adjustment of the front plate 40 is preferably limited by a ledge 48 projecting rearwardly from the top of front plate 40 and adapted to abut a stop 49 defined by the top of the front of the frame 30.

As best seen in FIG. 4, a leg assembly, generally designed 50, is slidably mounted on the frame 30 adjacent the bottom thereof. The leg assembly 50 is preferably a generally U-shaped unitary, integral piece containing a pair of horizontally spaced parallel leg projections 52 at the rear thereof and a pair of horizontally extending runners 56 extending outwardly from leg projections 52 along the length thereof and adapted for sliding movement along and atop the courses 37 of frame 30. A pair of vertically projecting guides 58 within the lower chamber 36 assist in maintaining the leg assembly 50 properly centered so that runners 56 rest on courses 37.

As illustrated by double-headed arrow B, the leg assembly 50 is movable between a retracted orientation and a projecting orientation. In the retracted orientation illustrated in phantom line in FIGS. 1 and 3, the leg assembly 50 does not extend substantially rearwardly out of the back of the frame 30 and thus does not increase the footprint of pusher 10. In the projecting orientation illustrated in solid line in FIGS. 1 and 3, the leg assembly 50 projects substantially rearwardly from the back of the frame 30 and thus increases the footprint of pusher 10.

Biasing means, generally designated 60, are provided to bias the leg assembly 50, rearwardly into the projecting orientation such that the leg projections 52 substantially project rearwardly from the rear of the frame 30, thereby to serve as a trailing outrigger and counteract any tendency of the product train to tip the pusher 10 over backwards (see the solid line depiction of pusher 10 in FIG. 1). On the other hand, when the pusher 10 is manually forced back against the back stop 16 (as it is during a product loading operation), the leg assembly 50 (and in particular the leg projections 52) is forced to substantially retract into the frame 20 into the retracted orientation, so that all of the shelf floor not occupied by the footprint of the pusher frame 30 is available for the receipt of more product P for the product train (see the phantom line depiction of pusher 10 in FIG. 1).

When the leg assembly 50 is in the projecting orientation (because it is spaced forwardly from the back stop 16), the leg assembly 50 (i.e., leg projections 52) substantially projects rearwardly from the back of the frame 30, thereby to preclude product from tipping the pusher 10 over backwards even when the backward resistance or inertia of the product train on the front plate 30 is focused at a point above the center of gravity of the pusher 10. It will be appreciated that the pusher 10 cannot be tipped over rearwardly when it is already abutting the rear stop 16 (which presumably immobilizes the pusher 10). The leg assembly 50 projects rearwardly adjacent the frame bottom in a generally horizontal plane and preferably in a plane parallel to the floor of shelf 12.

A variety of biasing means 60 well known in the mechanical arts may be used for biasing the leg assembly 50 to project rearwardly relative to the frame 20. As illustrated, a single compression spring is affixed at one end to a projection 62 on the leg assembly 50 and at the other end to a projection 64 on the frame 30 such that a contraction of the spring 60 causes the leg assembly 50 to assume its projecting orientation while a forcible expansion of the spring 60 (e.g., by abutment of leg assembly 50 against back stop 16) causes the leg assembly 50 to assume its retracted orientation.

The abutment of the rear of leg assembly 50 against projection 64 on frame 30 and the abutment of the front of leg assembly 50 against front plate 39 of frame 30 limits rearward and forward movement, respectively, of the leg assembly 50 relative to frame 30 and keeps at least a portion thereof within frame 30 and runners 56 on courses 37.

Thus the pusher 10 includes both means for preventing product from falling over the pusher frame 30 and means to prevent the product from tipping the pusher frame 30 over backwards. The former function is provided by a manually adjustable front plate 40 which does not unnecessarily occupy the space above the shelf, and the latter function is provided by a biased leg assembly 50 which does not unnecessarily reduce the available space for a product train.

Referring now to FIGS. 1 and 3, therein indicated fragmentarily is a strong but flexible tether 70. As a safety measure, tether 70 securely connects together the back of frame 30 at 72 and either the rear of the shelf 12 or an upright 18 at 74. The length of tether 70 is selected so that, in the event of the pusher 10 somehow falling forwardly over the front stop 14, it will not fall all the way down to the floor (where it might do injury to a customer's foot) but rather remains dangling from the tether above the floor.

To summarize, the present invention provides a weight-driven pusher which uses no sled (and thus does not carry any product on a sled), has a small footprint on the display shelf because it has a retractable rearwardly extending leg (which does not occupy valuable shelf space when the shelf is being loaded with a product train so that the length of the product train may be maximized), and preferably both. The present invention is suitable for use in a display shelf in a freezer and is simple and economical to manufacture, use and maintain.

Now that the preferred embodiments of the present invention have been shown and described in detail, various modifications and improvement thereon will become readily apparent to those skilled in the art. Accordingly the spirit and scope of the present invention is to be construed broadly and limited only by the appended claims, and not by the foregoing specification.

I claim:

1. A weight-driven pusher for product on a gravity-fed display shelf with an associated back stop, comprising:

(A) a weight driven pusher frame defining a compartment containing a weight and adapted for sliding movement along the gravity-fed display shelf;

(B) a front plate mounted on said frame in a generally vertical orientation for bearing on the back of product, said front plate being manually selectively adjustable in upper reach relative to said frame to accommodate product of varying height and preclude product from tipping rearwardly over the pusher;

(C) a leg assembly retractably mounted on said frame adjacent the bottom thereof for retraction into said frame as the back of said leg assembly bears on the associated back stop of the shelf; and (D) means biasing said leg assembly to project rearwardly from said frame when the back of said leg assembly is spaced from the back stop, thereby to preclude product from tipping the pusher over backwards.

2. The pusher of claim 1 wherein said leg assembly projects rearwardly in a generally horizontal plane.

3. The pusher of claim 1 wherein said front plate is manually selectively adjustable in a generally vertical plane to different vertical locations at which it is releasable retained.

4. The pusher of claim 3 wherein said leg assembly projects rearwardly in a generally horizontal plane.

* * * * *